US010933279B1

(12) United States Patent
Sallie

(10) Patent No.: US 10,933,279 B1
(45) Date of Patent: Mar. 2, 2021

(54) SIT-UP EXERCISE MACHINE

(71) Applicant: Robert Sallie, De Pere, WI (US)

(72) Inventor: Robert Sallie, De Pere, WI (US)

( * ) Notice: Subject to any disclaimer, the term of this patent is extended or adjusted under 35 U.S.C. 154(b) by 41 days.

(21) Appl. No.: 16/408,854

(22) Filed: May 10, 2019

(51) Int. Cl.
*A63B 23/02* (2006.01)
*A63B 21/00* (2006.01)
*A63B 21/062* (2006.01)

(52) U.S. Cl.
CPC ..... *A63B 23/0211* (2013.01); *A63B 21/0628* (2015.10); *A63B 21/154* (2013.01); *A63B 21/4031* (2015.10)

(58) Field of Classification Search
CPC ..... A63B 21/00058; A63B 21/00061; A63B 21/00065; A63B 21/00069; A63B 21/00076; A63B 21/00178; A63B 21/00181; A63B 21/00185; A63B 21/002; A63B 21/0023; A63B 21/0615; A63B 21/0616; A63B 21/0617; A63B 21/062; A63B 21/0622; A63B 21/0624; A63B 21/0626; A63B 21/0628; A63B 21/063; A63B 21/0632; A63B 21/15; A63B 21/151; A63B 21/152; A63B 21/154; A63B 21/4027; A63B 21/4029; A63B 21/4031; A63B 21/4045; A63B 21/4047; A63B 21/4049; A63B 22/0087; A63B 22/0089; A63B 23/02; A63B 23/0205; A63B 23/0211; A63B 23/0233; A63B 23/0238; A63B 2208/0228; A63B 2208/0233; A63B 2208/0238; A63B 2208/0242; A63B 2208/0247; A63B 2208/0252; A63B 2208/0261
See application file for complete search history.

(56) References Cited

U.S. PATENT DOCUMENTS 3,072,400 A 1/1963 Dykinga
4,372,553 A 2/1983 Hatfield
4,546,967 A * 10/1985 Kecala ..... A63B 21/4031 482/102
4,582,319 A * 4/1986 Luna ..... A63B 21/023 482/104
4,848,740 A * 7/1989 VanDerHoeven ... A63B 21/154 482/133
4,893,812 A * 1/1990 Dawson, Jr. ..... A63B 21/06 482/94
5,094,228 A * 3/1992 Reinert ..... A61H 1/008 606/243
5,094,449 A 3/1992 Stearns
5,273,508 A * 12/1993 Jones ..... A63B 23/0216 482/100
5,409,452 A * 4/1995 Aversano ..... A61H 1/0218 482/142
5,667,529 A * 9/1997 Butner ..... A61G 13/009 5/617
5,692,997 A * 12/1997 Stearns ..... A63B 21/154 482/100

(Continued)

*Primary Examiner* — Gary D Urbiel Goldner
(74) *Attorney, Agent, or Firm* — Cramer Patent & Design, PLLC; Aaron R. Cramer

(57) ABSTRACT

A sit-up exercise machine includes a frame, chair and system of pulleys secured to a plurality of free-weights by a cable. The chair is hinged at the back. The weights are secured in opposition to the back of the chair such that resistance is required by a user of the chair to push the back of the chair away from the seat of the chair.

17 Claims, 5 Drawing Sheets

(56) References Cited

U.S. PATENT DOCUMENTS 5,868,654 A * 2/1999 Norian ..... A63B 21/0615 482/127
5,928,118 A * 7/1999 Rosenthal ..... A63B 21/4029 482/133
5,938,575 A 8/1999 Stearns
6,093,135 A 7/2000 Huang
6,186,926 B1 2/2001 Ellis
6,406,412 B1 * 6/2002 Chen ..... A61H 1/0292 482/140
6,712,740 B2 3/2004 Simonson
6,896,643 B2 5/2005 Durfee, Jr.
7,481,752 B2 1/2009 Garner
7,575,538 B1 8/2009 Clark
7,608,022 B2 10/2009 Lull et al.
7,648,473 B1 * 1/2010 Peruvingal ..... A61H 1/0292 602/32
8,096,929 B2 1/2012 Habing et al.
8,734,304 B2 * 5/2014 Webber ..... A63B 21/4047 482/94
9,630,041 B2 4/2017 Ellis
2002/0022556 A1 * 2/2002 Eriksson ..... A63B 21/4047 482/92
2002/0128124 A1 * 9/2002 Mosimann ..... A63B 23/0405 482/92
2003/0032525 A1 * 2/2003 Pyles ..... A63B 21/155 482/8
2003/0092541 A1 * 5/2003 Giannelli ..... A63B 23/0233 482/99
2004/0166998 A1 * 8/2004 Campanaro ..... A63B 22/0023 482/95
2005/0159277 A1 * 7/2005 McVay ..... A63B 24/0087 482/142
2005/0159278 A1 * 7/2005 McVay ..... A63B 21/068 482/142
2005/0227828 A1 * 10/2005 Wu ..... A63B 21/0628 482/94
2006/0258518 A1 * 11/2006 Kessler ..... A63B 23/00 482/112
2007/0275835 A1 * 11/2007 Fishel ..... A63B 21/4047 482/92
2010/0280549 A1 * 11/2010 Yen ..... A61P 25/00 606/237
2010/0304933 A1 * 12/2010 Donaldson ..... A63B 21/023 482/8
2011/0143890 A1 * 6/2011 Reyes ..... A63B 21/4005 482/99
2013/0190142 A1 * 7/2013 Vaughns ..... A63B 23/0211 482/98
2014/0378282 A1 * 12/2014 Webber ..... A63B 71/0036 482/137
2016/0114207 A1 * 4/2016 Giannelli ..... A63B 21/0407 482/98
2017/0232292 A1 * 8/2017 Giannelli ..... A63B 21/063 482/98
2018/0001131 A1 * 1/2018 Nevarez, Jr. ..... A63B 23/0482
2018/0326258 A1 * 11/2018 Kordecki ..... A63B 21/4045

* cited by examiner

SIT-UP EXERCISE MACHINE

RELATED APPLICATIONS

None.

FIELD OF THE INVENTION

The present invention relates generally to the field of exercise machines and specifically to a sit-up exercise machine.

BACKGROUND OF THE INVENTION

Physical fitness and health concerns are among the areas of highest concern among Americans today. More than ever, people are frequenting health clubs and performing exercise routines at home in order to lose weight, improve muscle tone and maintain a healthy lifestyle. One exercise routine that has been around for generations is that of performing sit ups. Sit ups actually work the abdominals as well as other muscles groups, including the chest, hip flexors, the lower back, and even the neck.

However, such muscles only perform work when the user is actually in the process of sitting up. The other half of the exercise is returning one's torso to the floor, which literally takes no more work than carefully falling to the floor as gravity does much of the work. This leaves out many muscle groups and results in a less than a complete muscle workout. Accordingly, there exists a need for a means by which other core muscle groups can be exercised when performing sit up exercise routines. The development of the sit-up exercise machine fulfills this need.

SUMMARY OF THE INVENTION

The principles of the present invention provide for a weight assisted sit-up exercise machine, comprises a bench frame which has a fixed lower padded cushion and a pivoting upper padded cushion. The bench frame includes four legs, a lower support, an upper support, and a plurality of bracing. The machine also comprises a head frame; a foot frame which has a toe bar and a foot support near the fixed lower padded cushion to enable enhanced performance of a sit-up, a pair of weight travel guides each attached between a forwardmost portion of the lower support and a forwardmost portion of the cross arm and oriented parallel to each other and a cable attached to a distal end of the pivoting upper padded cushion. The cable is routed through a first pulley, a second pulley, a third pulley, a fourth pulley, and a fifth pulley before terminating at a plurality of weight platters, which are adjusted in quantity dependent on a user.

The weight platters slidably engage the pair of weight travel guides and are captured thereon. A pin enables a user to set a desired amount of the weight platters that are attached to the cable. Each of the weight platters have an aperture that is aligned with a receiver on the cable. Once the pin is set to a plurality specific weight platters, a stack of weight platters above the chosen weight platter travel upward with the cable along the pair of weight travel guides and the stack of weight platters below the chosen weight platters remain captured on the pair of weight travel guides and rest on the forwardmost portion of the lower support. A upper end of the pivoting upper padded cushion is connected to the cable by a harness.

The cable is supported by the first pulley, the second pulley, and the third pulley, the third pulley is connected to the upper support by two first support arms, the second pulley is connected via two second support arms to an upper cross member. A lower cross member provides support for two angle braces which provides support for the upper member supporting the first pulley. The machine also provides for an underside supporting frame which is connected at its lower end via pivot points into the upper support at its midpoint and an upper support supported by the four legs, the lower support, and the bracing.

The machine may also comprise cross arm located between two vertical foot members of the four legs. The user may position his or her feet between the foot support and the toe bar and thus prevents an upper movement while performing the sit-up. The stack of weight platters, through the cable produces an upward movement of the pivoting upper padded cushion which must be counteracted by a downward movement by a plurality of core muscles of the user, producing a strengthening effect in said muscles. The downward movement may be exerted by the user and thus provides an enhanced workout when returning to a prone position from the seated position along a movement travel path.

When the user is at the upward end of their travel path, he or she may then be ready to repeat the movement travel path to return to the prone position. While the feet of the user are still engaged upon the foot support and the toe bar, the user may be required to overcome the resistance of a chosen stack of weight platters imposed by the cable achieving an enhanced workout of the core muscles. A digital counter may be provided to count a plurality of repetition cycles to facilitate repetitions of the movement travel path. The bench frame, the four legs, the lower support, the upper support, the bracing, the head frame, and the foot frame may be made of tube steel and plate steel construction.

The bench frame, the four legs, the lower support, the upper support, the bracing, the head frame, and the foot frame are cut to length and welded together. The weight platters may be identical in weight while the fixed lower padded cushion and the pivoting upper padded cushion sitting atop the four legs and additional members of the lower support, the upper support, and the bracing may include a bench-style arrangement. The cable may extend downward from the fifth pulley and attached to the weight platters while the fifth pulley may be supported by two hanging members.

A method for utilizing a weight assisted sit-up exercise machine comprises first, sitting a foot support upon a fixed lower padded cushion of the machine; second, engaging a user's feet between the foot support and a toe bar; third, the user utilizing core muscles and upper body strength to push the fixed lower padded cushion along a movement travel path; fourth, the pushing causes a chosen stack of weight platters to rise; with said pushing continuing until the pivoting upper padded cushion is in a flat horizontal position; and last, reversing the method to slowly bring the user's upper body into a seated position thus lowering the chosen stack of weight platters and completing one cycle.

The method is designed to provide an enhanced workout and increased development of the core muscles of the user. The user may also place his or her hands and arms behind their head.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
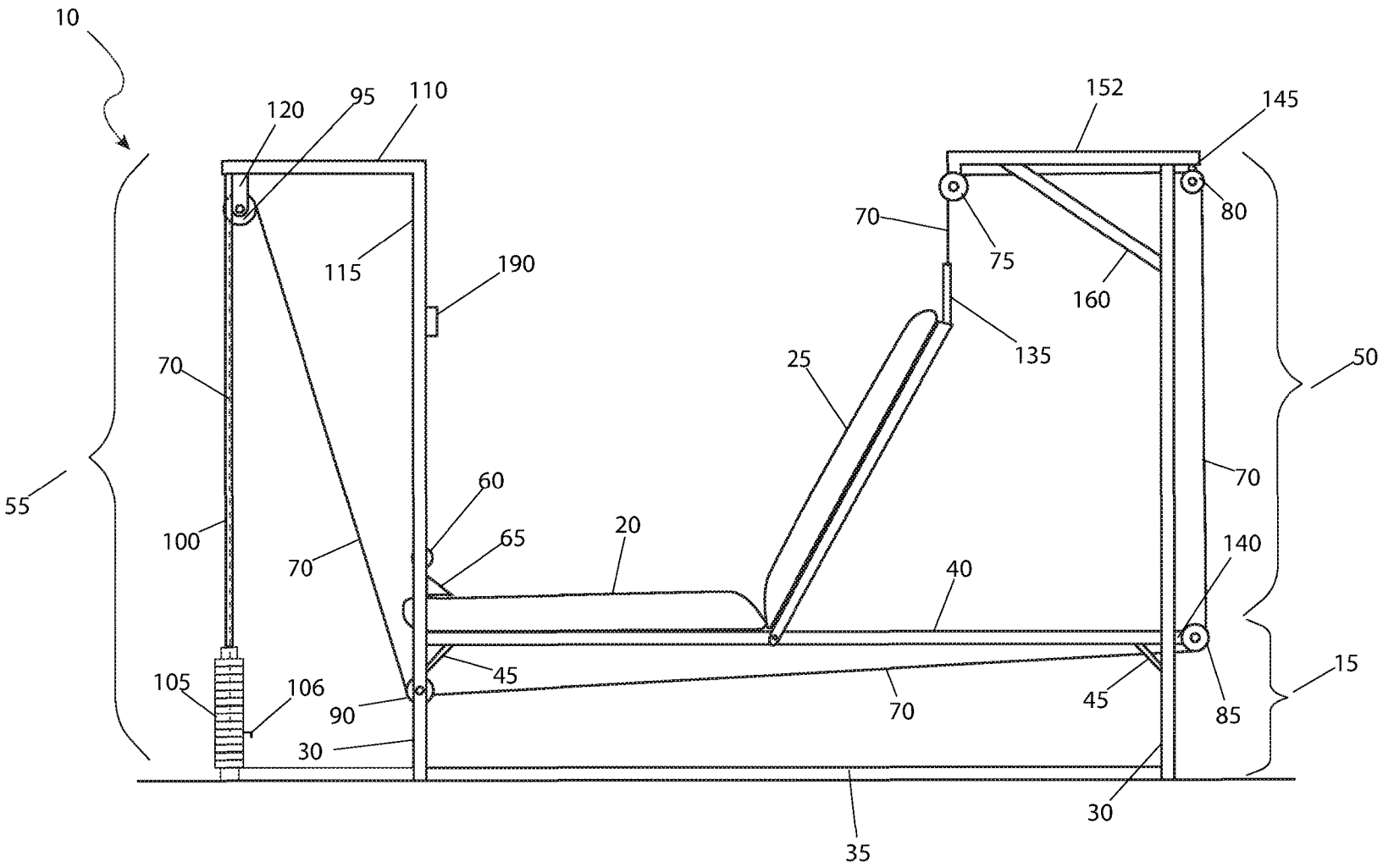
FIG. 1 is a front view of the weight assisted sit-up exercise machine 10, according to the preferred embodiment of the present invention.

10 weight assisted sit-up exercise machine
15 bench frame
20 fixed lower padded cushion
25 pivoting upper padded cushion
30 leg
35 lower support
40 upper support
45 bracing
50 head frame
55 foot frame
60 toe bar
65 foot support
70 cable
75 first pulley
80 second pulley
85 third pulley
90 fourth pulley
95 fifth pulley
100 weight travel guide
105 weight platter
106 pin
110 cross arm
115 vertical foot member
120 hanging member
125 underside supporting frame
130 pivot point
135 harness
140 first support arm
145 second support arm
150 upper cross member
152 upper member
155 lower cross member
160 angle brace
165 user
170 feet
175 upper movement "lu"
180 downward movement "ld"
185 movement travel path "lm"
190 digital counter

DESCRIPTION OF THE PREFERRED EMBODIMENTS

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. DETAILED DESCRIPTION OF THE FIGURES

Referring now to FIG. 1, a front view of the weight assisted sit-up exercise machine 10, according to the preferred embodiment of the present invention is disclosed. The weight assisted sit-up exercise machine 10 (herein also described as the "machine") 10, includes a bench frame 15 with a fixed lower padded cushion 20 and a pivoting upper padded cushion 25. The bench frame 15 includes four (4) legs 30 (of which only two (2) are shown due to illustrative limitations), a lower support 35, an upper support 40, and bracing 45. A head frame 50 and a foot frame 55 are also provided and will be described in greater detail herein below.

It is envisioned that the bench frame 15, the legs 30, the lower support 35, the upper support 40, the bracing 45, the head frame 50, and the foot frame 55 would be made of tube steel and plate steel construction. These components would be cut to length and welded together according to a pattern. After manufacture, a suitable protective finish such as paint or plating would be applied to prevent corrosion. A toe bar 60 and a foot support 65 is provided on the foot frame 55 near the fixed lower padded cushion 20. The toe bar 60 and the foot support 65 enable enhanced performance of sit-ups and will be described in greater detail herein below. A cable 70 is attached to the distal end of the pivoting upper padded cushion 25 and is routed through a first pulley 75, a second pulley 80, a third pulley 85, a fourth pulley 90, and a fifth pulley 95 before terminating at a plurality of weight platters 105, which can be adjusted in quantity dependent on the user. It is preferred that each of the weight platters 105 are identical in weight.

Figure 2:
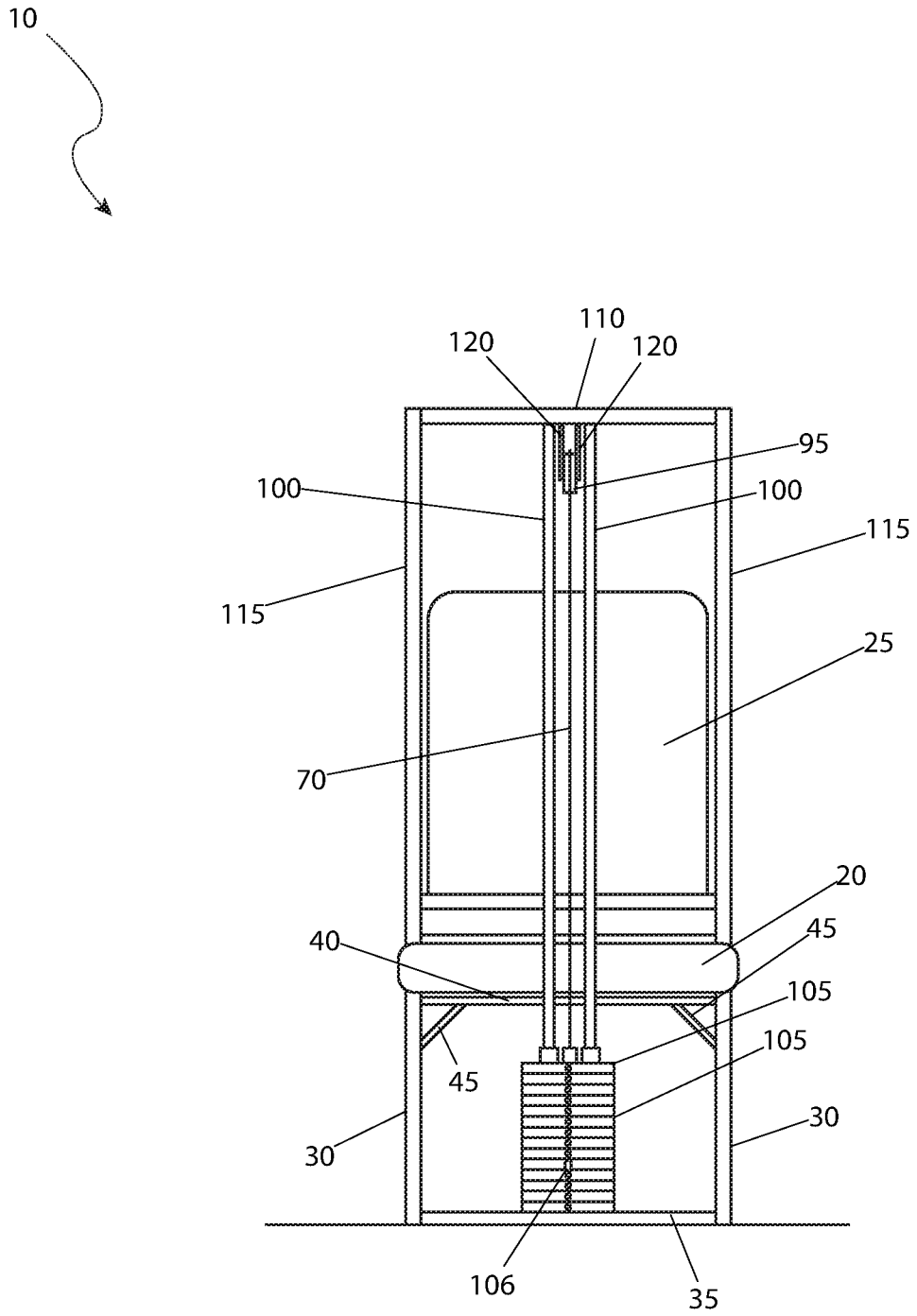
FIG. 2 is a left-side view of the weight assisted sit-up exercise machine 10, according to the preferred embodiment of the present invention.

Referring next to FIG. 2, a left-side view of the machine 10, according to the preferred embodiment of the present invention is depicted. This view discloses the bench-style arrangement of the fixed lower padded cushion 20 and the pivoting upper padded cushion 25 sitting atop the legs 30 and additional members of the lower support 35, the upper support 40, and the bracing 45. The cable 70 is shown extending downward from the fifth pulley 95 and attached to the plurality of weight platters 105. A cross arm 110 is located between two (2) vertical foot members 115. The fifth pulley 95 is supported by two (2) hanging members 120.

A pair of weight travel guides 100 are each attached between a forwardmost portion of the lower support 35 and a forwardmost portion of the cross arm 100 and oriented parallel to each other. The plurality of weight platters 105 slidably engage the pair of weight travel guides 100 and are captured thereon. A pin 106 enables a user to set the desired amount of the plurality of weight platters 105 that are attached to the cable 70. Each weight platter 105 has an aperture therein that is aligned with a receiver on the cable 70. Once the pin 106 is set in a specific weight platters 105, the stack of weight platters 105 above the chosen weight platter 105 travel upward with the cable 70 along the pair of weight travel guides 100 and the stack of weight platters 105 below the chosen weight platter 105 remain captured on the pair of weight travel guides 100 and rest on the forwardmost portion of the lower support 35.

Figure 3:
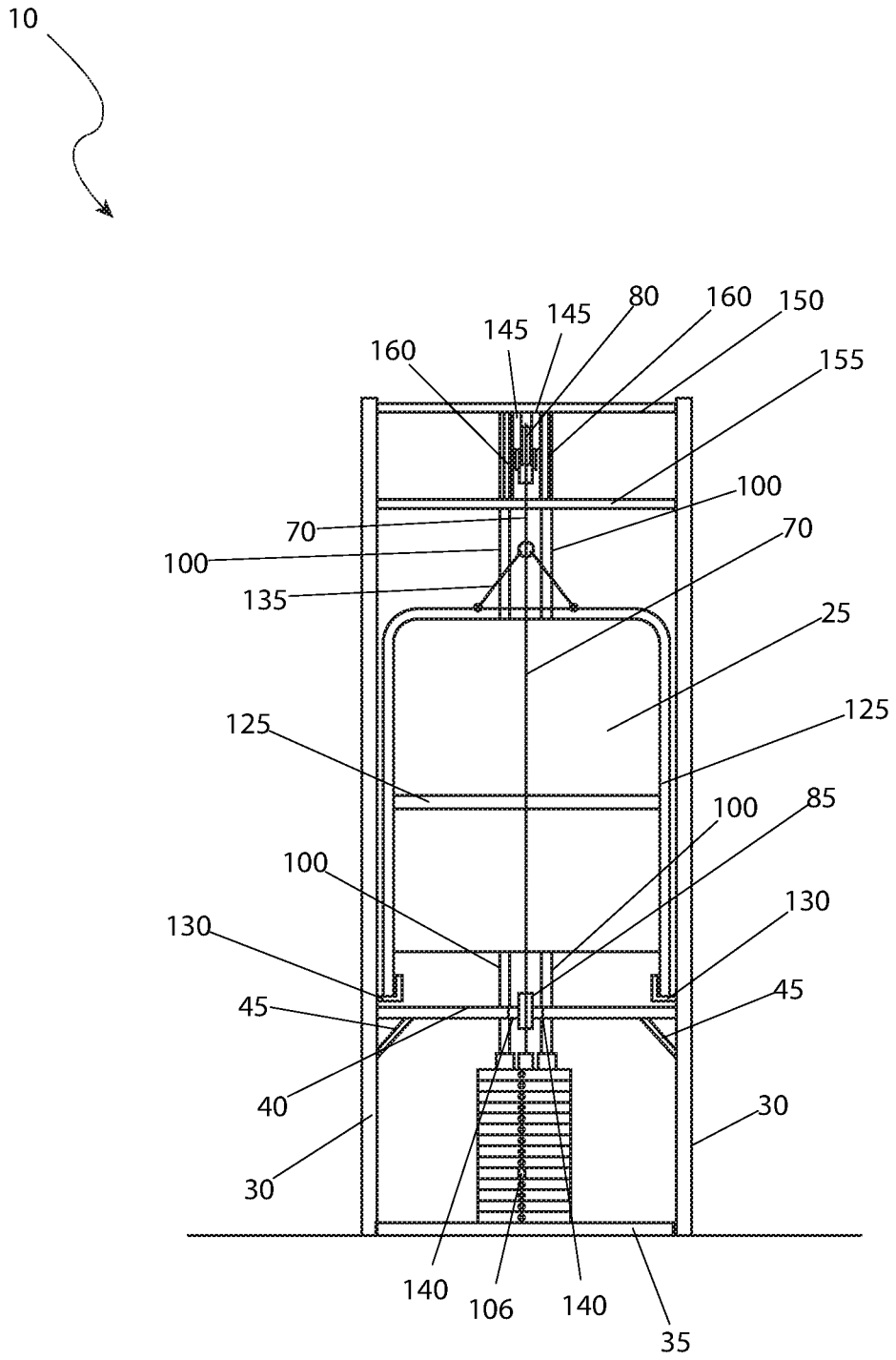
FIG. 3 is a right-side view of the weight assisted sit-up exercise machine 10, according to the preferred embodiment of the present invention.

Referring now to FIG. 3, a right-side view of the machine 10, according to the preferred embodiment of the present invention is shown. This view discloses the underside of the pivoting upper padded cushion 25 with its underside supporting frame 125. The underside supporting frame 125 is connected at its lower end via pivot points 130 into the upper support 40 at its midpoint as shown in FIG. 1. The upper support 40 is supported by the legs 30, the lower support 35, and the bracing 45 in a manner similar to that shown on the remaining three (3) sides as aforementioned described. The upper end of the pivoting upper padded cushion 25 is connected to the cable 70 by a harness 135. The cable 70 is supported by the first pulley 75 (not visible in this figure due to illustrative limitations), the second pulley 80, and the third pulley 85. The third pulley 85 is connected to the upper support 40 by two (2) first support arms 140. In a similar manner, the second pulley 80 is connected via two (2) second support arms 145 to an upper cross member 150. A lower cross member 155 provides support for two (2) angle braces 160 which provides support for the upper member 152 supporting the first pulley 75 (not visible in this figure due to illustrative limitations).

Figure 4:
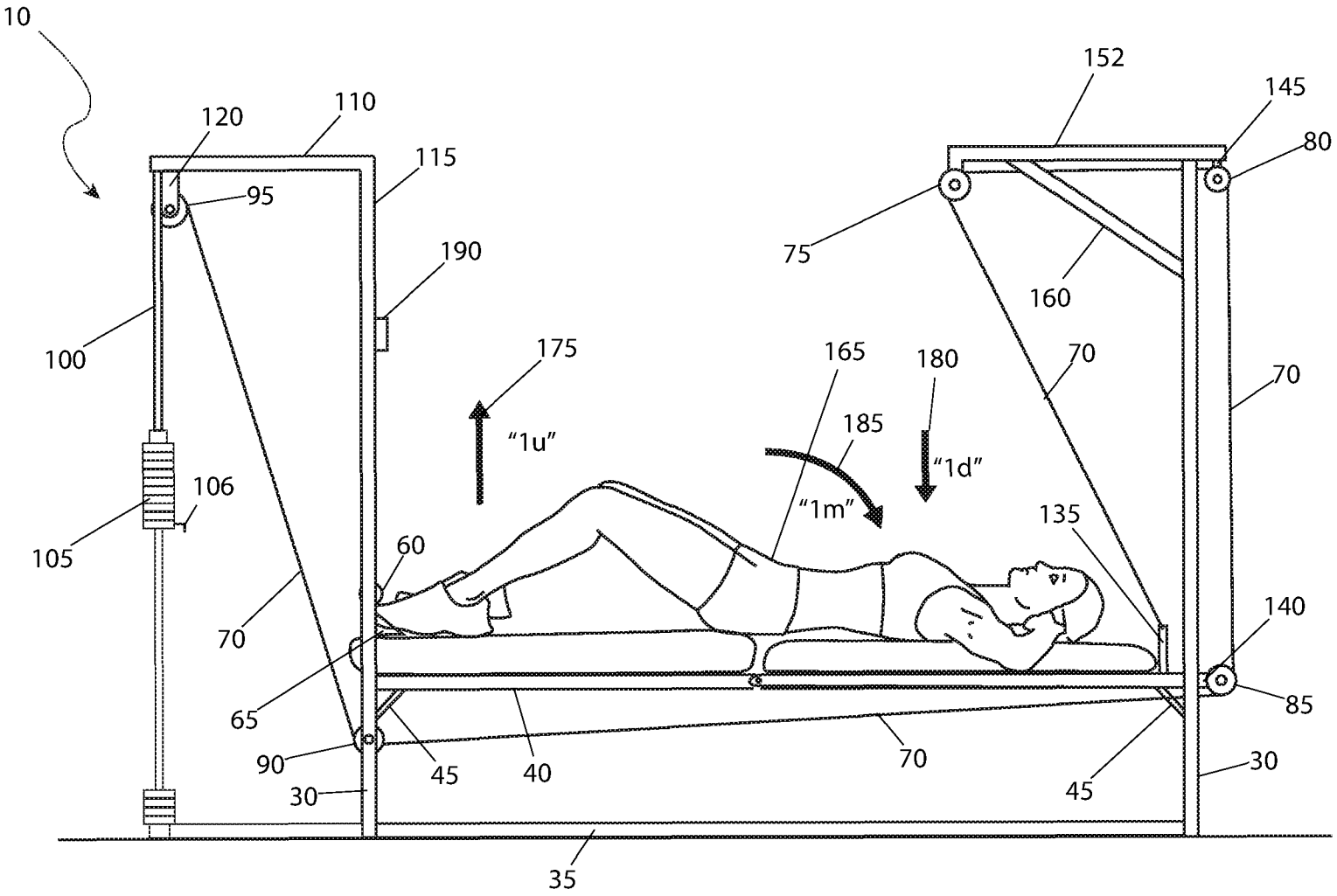
FIG. 4 is a perspective view of the weight assisted sit-up exercise machine 10, with the user 165 in a prone position, according to the preferred embodiment of the present invention; and, FIG. 5 is a perspective view of the weight assisted sit-up exercise machine 10, with the user 165 in a seated position, according to the preferred embodiment of the present invention.

Referring next to FIG. 4, a perspective view of the machine 10, with the user 165 in a prone position, according to the preferred embodiment of the present invention is disclosed. The user 165 positions their feet 170 between the foot support 65 and the toe bar 60 and thus prevents the occurrence of an upper movement "lu" 175 while performing a sit-up. The chosen stack of weight platters 105, through the cable 70 produce an upward movement of the pivoting upper padded cushion 25 which must be counteracted by a downward movement "ld" 180 by the core muscles of the user 165, producing a strengthening effect in said muscles. This downward movement "ld" 180 must be exerted by the user 165 and thus provides an enhanced workout when returning to the prone position from the seated position along a movement travel path "lm" 185.

Figure 5:
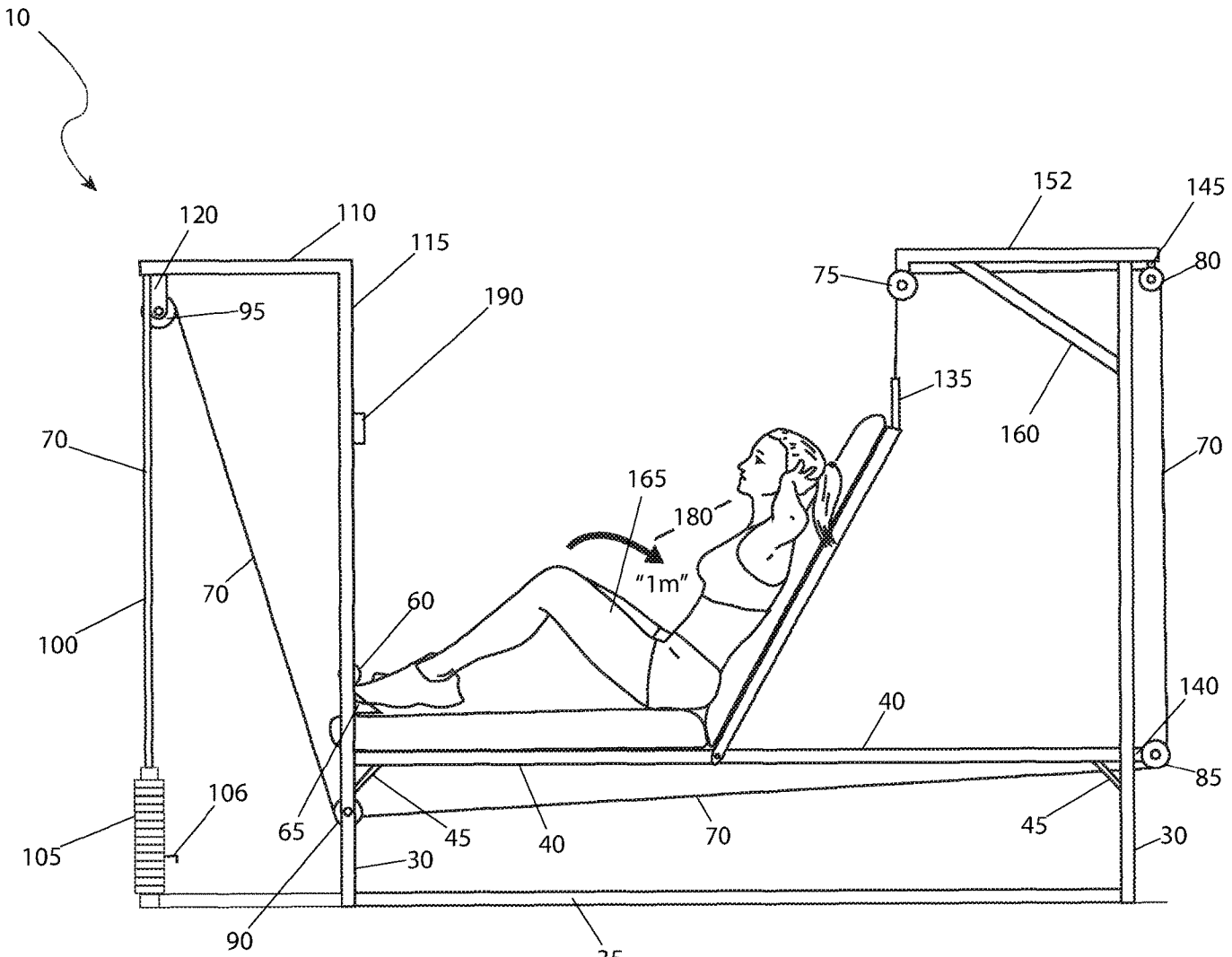

Referring to FIG. 5, a perspective view of the machine 10. With the user 165 in a seated position, according to the preferred embodiment of the present invention is depicted. The user 165 is at the upward end of their travel path and now ready to repeat the movement travel path "lm" 185 to return to a prone position as shown in FIG. 4. The feet 170 of the user 165 are still engaged upon the foot support 65 and the toe bar 60. The user 165 must overcome the resistance of the chosen stack of weight platters 105 imposed by the cable 70. As such, an enhanced workout of the core muscles is achieved. To facilitate repetitions of the movement defined by the motion between FIG. 4 and FIG. 5, a digital counter 190 which counts repetition cycles may be provided.

2. OPERATION OF THE PREFERRED EMBODIMENT

The preferred embodiment of the present invention can be utilized by the common user in a simple and effortless manner with little or no training. It is envisioned that the machine 10 would be constructed in general accordance with FIG. 1 through FIG. 5. The user would procure the machine 10 through normal procurement channels of exercise equipment. Various parameters such as overall size, maximum amount of weight platters 105 accounted for, color and the like would be chosen.

After procurement and prior to utilization, the machine 10 would be prepared in the following manner: the machine 10 would be set up and configured as shown in FIG. 1. The pivoting upper padded cushion 25 would be in an upright position due to mass of the weight platters 105, and the digital counter 190 would be reset. A chosen stack of weight platters 105 is secured by insertion of the pin 106 into the bottommost of the chosen stack of weight platters 105 and into the receiver of the cable 70.

During utilization of the machine 10, the following procedure would be followed: the foot support 65 would sit upon the fixed lower padded cushion 20; their feet 170 would be engaged between the foot support 65 and the toe bar 60; their hands and arms would be placed behind their head as shown in FIG. 5; user 165 would utilize core muscles and upper body strength to push the fixed lower padded cushion 20 along the movement travel path "lm" 185; said pushing would cause the chosen stack of weight platters 105 to rise; said pushing would continue until the pivoting upper padded cushion 25 is in a flat horizontal position as shown in FIG. 4; process then reverses and slowly brings their upper body into a seated position thus lowering the chosen stack of weight platters 105 and completing one (1) cycle. The usage may then repeat at a later time by the same or different user 165. Usage of the machine 10 is envisioned to provide an enhanced workout and increased development of the core muscles of the user 165.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A weight assisted sit-up exercise machine, comprising:

a bench frame having a fixed lower padded cushion and a pivoting upper padded cushion, the bench frame includes four legs, a lower support, an upper support, and a plurality of bracing;

a head frame;

a foot frame having a toe bar and a foot support near the fixed lower padded cushion to enable enhanced performance of a sit-up;

a pair of weight travel guides each attached between a forwardmost portion of the lower support and a forwardmost portion of a cross arm and oriented parallel to each other;

a cable attached to a distal end of the pivoting upper padded cushion and routed through a first pulley, a second pulley, a third pulley, a fourth pulley, and a fifth pulley before terminating at a plurality of weight platters, the plurality of weight platters are configured to be selectively adjusted in quantity by a user, the plurality of weight platters slidably engage the pair of weight travel guides and are captured thereon, a pin is configured to enable the user to set a desired quantity of the plurality of weight platters that are attached to the cable, each of the plurality of weight platters have an aperture therein that is aligned with a receiver on the cable, wherein once the pin is set to a bottom weight platter of the desired quantity of the plurality of weight platters, the desired quantity of the plurality of weight platters travels upward with the cable along the pair of weight travel guides, and a remaining stack of the plurality of weight patters below the bottom weight platter remains captured on the pair of weight travel guides and rests on the forwardmost portion of the lower support, the distal end of the pivoting upper padded cushion is connected to the cable by a harness, the cable is supported by the first pulley, the second pulley, and the third pulley, the third pulley is connected to the upper support by two first support arms, the second pulley is connected via two second support arms to an upper cross member, and a lower cross member provides support for two angle braces which provide support for an upper member supporting the first pulley;

an underside supporting frame connected at a lower end thereof via pivot points into the upper support at a midpoint thereof; and wherein the upper support is supported by the four legs, the lower support, and the plurality of bracing.

2. The weight assisted sit-up exercise machine according to claim 1, wherein the cross arm is located between two vertical foot members of the four legs.

3. The weight assisted sit-up exercise machine according to claim 1, wherein the foot support and the toe bar are configured to engage feet of the user therebetween, thereby preventing an upper movement of the user while the user performs the sit-up.

4. The weight assisted sit-up exercise machine according to claim 3, wherein the desired quantity of the plurality of weight platters, through the cable produces an upward movement of the pivoting upper padded cushion configured to be counteracted by a downward movement by a plurality of core muscles of the user, producing a strengthening effect in the plurality of core muscles of the user.

5. The weight assisted sit-up exercise machine according to claim 4, wherein the weight assisted sit-up exercise machine is configured such that the downward movement must be exerted by the user, thereby providing an enhanced workout when the user returns to a prone position from a seated position along a movement travel path.

6. The weight assisted sit-up exercise machine according to claim 5, wherein the weight assisted sit-up exercise machine is configured such that when the user is at an upward end of the movement travel path, the user is now ready to repeat the movement travel path to return to the prone position.

7. The weight assisted sit-up exercise machine according to claim 5, wherein the weight assisted sit-up exercise machine is configured such that while the feet of the user are still engaged between the foot support and the toe bar, the user must overcome a resistance of the desired quantity of the plurality of weight platters imposed by the cable, thereby achieving the enhanced workout of the plurality of core muscles of the user.

8. The weight assisted sit-up exercise machine according to claim 6, further comprising a digital counter to count a plurality of repetition cycles to facilitate repetitions of the movement travel path.

9. The weight assisted sit-up exercise machine according to claim 1, wherein the bench frame, the four legs, the lower support, the upper support, the plurality of bracing, the head frame, and the foot frame are made of tube steel and plate steel construction.

10. The weight assisted sit-up exercise machine according to claim 1, wherein the bench frame, the four legs, the lower support, the upper support, the plurality of bracing, the head frame, and the foot frame are cut to length and welded together.

11. The weight assisted sit-up exercise machine according to claim 1, wherein each of the plurality of weight platters are identical in weight.

12. The weight assisted sit-up exercise machine according to claim 1, wherein the fixed lower padded cushion and the pivoting upper padded cushion sit atop the four legs and additional members of the lower support, the upper support, and the plurality of bracing include a bench-style arrangement.

13. The weight assisted sit-up exercise machine according to claim 1, wherein the cable extends downward from the fifth pulley and attaches to the plurality of weight platters.

14. The weight assisted sit-up exercise machine according to claim 1, wherein the fifth pulley is supported by two hanging members.

15. A method for utilizing a weight assisted sit-up exercise machine, the method comprising the steps of:

setting a foot support upon a fixed lower padded cushion of the weight assisted sit-up exercise machine;

engaging a user's feet between the foot support and a toe bar;

the user utilizing core muscles and upper body strength to push a pivoting upper padded cushion along a movement travel path;

the pushing causes a chosen stack of weight platters to rise;

said pushing would continue until the pivoting upper padded cushion is in a flat horizontal position; and reversing the method to slowly bring the user's upper body into a seated position thus lowering the chosen stack of weight platters and completing one cycle.

16. The method according to claim 15, wherein the method provides an enhanced workout and increased development of the core muscles of the user.

17. The method according to claim 15, wherein the user places their hands and arms behind their head.

* * * * *